US009080830B2

(12) United States Patent
Hendricks et al.

(10) Patent No.: US 9,080,830 B2
(45) Date of Patent: Jul. 14, 2015

(54) DART GUN

(71) Applicant: BLACKPOWDER PRODUCTS, INC., Duluth, GA (US)

(72) Inventors: Mark D. Hendricks, Duluth, GA (US); Larry N. Treadway, Monroe, GA (US)

(73) Assignee: BLACKPOWDER PRODUCTS, INC., Duluth, GA (US)

( * ) Notice: Subject to any disclaimer, the term of this patent is extended or adjusted under 35 U.S.C. 154(b) by 34 days.

(21) Appl. No.: 13/948,964

(22) Filed: Jul. 23, 2013

(65) Prior Publication Data

US 2014/0360070 A1 Dec. 11, 2014

Related U.S. Application Data

(60) Provisional application No. 61/831,431, filed on Jun. 5, 2013.

(51) Int. Cl.

| | |
|---|---|
| ***F41B 7/08*** | (2006.01) |
| ***F41B 11/60*** | (2013.01) |
| ***F41B 11/85*** | (2013.01) |
| ***F41A 21/10*** | (2006.01) |
| ***F41A 35/00*** | (2006.01) |

(52) U.S. Cl.

CPC ..... *F41B 11/60* (2013.01); *F41A 21/10* (2013.01); *F41A 35/00* (2013.01); *F41B 7/08* (2013.01); *F41B 11/85* (2013.01)

(58) Field of Classification Search

CPC ..... F42B 12/66; F41B 11/89; F41B 11/85; F41B 11/83; F41B 7/08

USPC ..... 89/1.14, 1.34; 124/28, 58

See application file for complete search history.

(56) References Cited

U.S. PATENT DOCUMENTS

| | | | | |
|---|---|---|---|---|
| 3,837,107 | A * | 9/1974 | Swaim et al. | 42/105 |
| 4,553,480 | A * | 11/1985 | McLellan | 102/430 |
| 4,843,747 | A | 7/1989 | Echeberria | |
| 5,109,622 | A | 5/1992 | Echeberria | |
| 5,657,569 | A | 8/1997 | Jernigan et al. | |
| 6,216,380 | B1 | 4/2001 | McGarity, Jr. et al. | |
| 7,065,913 | B2 | 6/2006 | Lizarralde et al. | |
| 7,877,919 | B2 * | 2/2011 | Richards | 42/51 |
| 8,312,657 | B2 | 11/2012 | Lizarralde Ibarguren | |

(Continued)

FOREIGN PATENT DOCUMENTS

WO WO 2012/171064 * 12/2012

OTHER PUBLICATIONS

Cammack Ranch Supply; Dakota Dart Gun; date unknown (2 pgs).

*Primary Examiner* — Stephen M Johnson

(74) *Attorney, Agent, or Firm* — Gardner Groff Greenwald & Villanueva, PC

(57) ABSTRACT

A dart gun for medicating or tranquilizing animals, which includes a barrel and a breech plug, the barrel including a bore defining a longitudinal axis extending from a muzzle end to a breech end, and the breech end including a breech plug chamber and a notch. The breech plug is removably engageable with the breech plug chamber and includes a plug member, an extractor, and a baffle member. The extractor provides convenient loading, firing and ejecting of a blank firing cartridge that is used to fire the dart from the barrel. The baffle rod provides for muffling the sound of the explosion of the blank firing cartridge, and reduces the amount of heat and flames that are exposed to the dart when firing the blank firing cartridge.

10 Claims, 12 Drawing Sheets

(56) References Cited

U.S. PATENT DOCUMENTS

| | | | |
|---|---|---|---|
| 2005/0115129 | A1 | 6/2005 | Lizarralde et al. |
| 2006/0048423 | A1 | 3/2006 | Echeberria et al. |
| 2007/0039222 | A1 | 2/2007 | Lizarralde et al. |
| 2010/0229446 | A1 | 9/2010 | Ibarguren |
| 2012/0297657 | A1 | 11/2012 | Ibarguren |
| 2013/0219764 | A1 | 8/2013 | Ibarguren |
| 2013/0219765 | A1 | 8/2013 | Ibarguren |

* cited by examiner

DART GUN

CROSS-REFERENCE TO RELATED APPLICATION

This application claims the benefit of U.S. Provisional Patent Application Ser. No. 61/831,431 filed Jun. 5, 2013, the content of which is hereby incorporated herein by reference in its entirety.

TECHNICAL FIELD

The present invention relates generally to the field of firearms, and more particularly to a firearm for projecting a dart or projectile, for example for tranquilizing or medicating animals.

BACKGROUND

Dart guns are used to medicate or tranquilize an animal with a chemical substance or medication. The dart gun fires a dart or ballistic syringe that contains the chemical substance, and when a sharp tip portion or needle of the dart penetrates the skin of a animal, the chemical substance is injected into the animal. Typically, dart guns are used when handling or capturing the animal in a conscious state would be dangerous or difficult and time consuming.

The dart or ballistic syringe is typically generally cylindrical in shape and includes a central body portion for containing the chemical substance (medication or drug), a front needle for penetrating the skin and delivering the dose of medication or drug, and fletchings mounted to the rear end for stabilizing the dart while in flight. Typically, a steel ball, priming substance or pressurized valve is used in conjunction with the dart to cause the dose to be injected into the subject on impact, and sometimes the dart has other features that automatically remove the dart from the animal after administering the dose. In most cases, the dart is usually .50 caliber or 12.95 millimeters in diameter (typical diameter of a .50 caliber bullet or firearm cartridge). The guns used to fire the darts generally take the form of a rifle or long gun, pistol, crossbow or breath-powered blowgun.

Typically, in the rifle category, dart guns are either powered by compressed carbon dioxide ($CO_2$) or exploding gunpowder (e.g., similar to standard firearm cartridges utilizing gunpowder to fire a bullet). For compressed $CO_2$ powered rifles, a can or cartridge containing the compressed $CO_2$ mounts to the rifle and provides a supply of pressurized gas to the barrel. When the trigger is pulled, a burst of gas shoots into the back of the barrel (behind the dart), generating a large amount of pressure and causing the dart to fire out of the barrel. In most cases, the amount of shots per a given cartridge will vary depending on several factors including the size of the cartridge, the amount of $CO_2$ contained within the cartridge, and the ambient temperature of the air surrounding the cartridge. $CO_2$ powered dart guns may not be favored in cold environments because of reduced operability. Also, $CO_2$ powered dart guns may be disfavored because it is difficult or impossible to know when the next shot will fail due to insufficient pressurization when the cartridge runs out of gas, often resulting in waste of an expensive dose of medication in a lost or contaminated dart.

Rifles using exploding gunpowder as the propellant are generally in the form of a shotgun, for example, wherein a shot shell adapter (generally shaped like a traditional shotgun shell) is provided for firing the dart from the barrel. Typically, the shot shell adapter accepts a blank .22 caliber cartridge (offset from the center of the bore to allow the centered firing pin to strike the rim) and is loaded in the shotgun like a traditional break action shotgun. Depending on the particular location of the dart within the barrel (usually placed right in front of the shot shell adapter, or may be spaced a distance away by an extension rod extending therefrom), the explosion of the gunpowder within the shot shell adapter can cause damage to the fletchings of the dart, potentially affecting the flight of the dart and missing the target, which can be very costly where the dose is wasted due to injecting on impact. After firing the blank cartridge, the shell shot adapter is removed from the shotgun and the extension rod can be unscrewed and used to eject the used blank firing cartridge from the shot shell adapter, which is known to be a tedious and time consuming process. Additionally, and especially for large animals, loud noises are known to cause severe stress, and adding additional stress to large animals can potentially reduce their chances of surviving. Also, many countries' laws impose restrictions on sale and transport of firearms and ammunition, which can create difficulties in use of standard firearms adapted for use as a dart gun.

Accordingly, it can be seen that needs exist for an improved dart gun. It is to the provision of an improved dart gun meeting these and other needs that the present invention is primarily directed.

SUMMARY

In example embodiments, the present invention provides an improved dart gun, for example for use in medicating or sedating animals. In one aspect, the present invention relates to dart gun having a barrel with a bore defining a longitudinal axis extending from a muzzle end to a breech end, and with the breech end having a breech adapter receiving chamber formed therein. The dart gun preferably also includes a breech adapter for removable engagement within the breech adapter receiving chamber. The breech adapter preferably includes a plug having a first chamber portion at a proximal side thereof for receiving a cartridge, and a second chamber portion at a distal side thereof for delivering a propellant charge from the cartridge to the barrel. The breech adapter preferably also includes an extractor movable between a first position wherein the cartridge is engaged with the extractor and seated in the first chamber portion of the plug, and a second position wherein the cartridge is engaged with the extractor and retracted out of the first chamber portion of the plug. The breech adapter preferably also includes a baffle member extending from the distal side of the plug.

In another aspect, the invention relates to a dart gun including a barrel and a breech plug. The barrel includes a bore defining a longitudinal axis that extends from a muzzle end to a breech end. The breech end includes a breech plug chamber and a notch. The breech plug is removably engagable with the breech plug chamber and includes a plug member, an extractor and a baffle member. The extractor movably mounts to a portion of the plug member and includes a body portion and a flange. The extractor is in a neutral position when the plug member is removably engaged with the breech plug chamber and the body portion is aligned with the notch, and the extractor is in an ejection position when the plug member is removably engaged with the breech plug chamber and the body portion is out of alignment with the notch.

In another aspect, the invention relates to a breech adapter for removable engagement with a firearm barrel. The firearm barrel includes a bore defining a longitudinal axis extending from a muzzle end to a breech end, and the breech end includes a breech plug chamber and a notch. The breech adapter includes a plug member and an extractor. The plug member generally extends from a first end to a second end and includes a first body portion, a second body portion, a first chamber, a second chamber, and a channel. The second body portion is configured to removably engage the breech plug chamber. The first and second chambers communicate therewith to define an internal conduit extending from the first end to the second end. The channel extends from the first end, through the first body portion, and through a portion of the second body portion along an external surface thereof. The extractor is configured to cooperate with the notch of the barrel. The extractor includes a body portion and a flange generally extending perpendicular from the flange. The body portion movably mounts within the channel and is movable between a neutral position and an ejection position. The extractor is in the neutral position when the flange is seated against the first chamber of the plug member, and the extractor remains in the neutral position when the plug member removably engages the breech plug chamber and the body portion is aligned with the notch. The extractor is in the ejection position when the flange is laterally offset from the first chamber of the plug member, and the extractor remains in the ejection position when the plug member removably engages the breech plug chamber and the body portion is out of alignment with the notch.

In still another aspect, the invention relates to a breech adapter for removable engagement with a barrel of a firearm to allow the firearm to fire a dart. The breach adaptor preferably includes a generally cylindrical body having a proximal end and a distal end. A first chamber preferably extends from the proximal end toward the distal end and a second chamber preferably extends from the distal end toward the proximal end. The first and second chambers are preferably at least partially intersecting within the generally cylindrical body of the breech adaptor to allow fluid communication between the first and second chambers. The first chamber defines a first axis and the second chamber defines a second axis that is preferably transversely offset by an offset distance from the first axis.

In another aspect, the invention relates to a breech adapter for removable engagement with a barrel of a firearm to allow the firearm to fire a dart. The breach adaptor preferably includes a first chamber for receiving a propellant cartridge, and an extractor movable between a first position allowing the propellant cartridge to be received in the first chamber and a second position extracting the propellant cartridge from the first chamber. The extractor preferably includes a body and a flange extending transversely from the body, wherein at least a portion of the body is positioned external of the breech adaptor, whereby engagement of the flange against the cartridge extracts the cartridge from the first chamber as the extractor moves toward its second position upon pressing the external portion of the body against a contact surface.

In yet another aspect, the invention relates to a breech adapter for removable engagement with a barrel of a firearm to allow the firearm to fire a dart. The breach adaptor preferably includes a proximal end and a distal end, the distal end being configured to be received within a breech end of the barrel. The breech adaptor preferably also includes a baffle member extending from the distal end, the baffle member comprising a baffle rod and at least one baffle extending transversely from the baffle rod, each baffle having an edge defining a propellant passage between the baffle and a bore wall of the barrel when the breech adapter is installed in the firearm.

In another aspect, the invention relates to a breech adapter including a plug member, an extractor and a baffle rod. The plug member includes a generally cylindrical body extending from a first end to a second end. A first body portion is formed at the first end thereof and a second body portion formed at the second end thereof. A first chamber is formed within the first body portion and a second chamber is formed within the second body portion. The first and second chambers communicate therewith to define an internal conduit extending from the first end to the second end. A channel extends from the first end, through the first body portion, and through a portion of the second body portion along an external surface thereof. The extractor includes a body portion and a flange. The flange generally extends transversely from the body portion. The body portion movably mounts within the channel and is movable between a neutral position wherein the flange is received within a portion of the first chamber and a ejection position wherein the flange is laterally offset from the first chamber. The baffle rod forms a generally cylindrical body extending from a first end to a second end. The baffle rod includes a chamber extending from the first end towards the second end, and at least one port communicating with the chamber. The first end includes a connecting portion having a connection area for mounting to the second chamber of the plug member. The second end includes a baffle portion having a plurality of axially spaced ribs.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

BRIEF DESCRIPTION OF THE DRAWINGS

FIG. 11C shows a perspective view of the animal capture dart gun shown in FIG. 11C, showing the breech adapter removably engaged with the breech wherein the extractor protrudes from the plug member and ejects the used blank firing cartridge therefrom.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Generally described, the present invention comprises a dart gun or firearm for firing or projecting darts or other projectiles to medicate or tranquilize an animal. In example forms, the darts generally comprise a medicine or tranquilizing substance that can be used to medicate, tranquilize or immobilize mammals or other animals, for example wherein treating or tending to the animal while it is conscious may be dangerous, difficult or otherwise not advisable. To project the dart or projectile from the firearm, a breech adapter is provided to accept a blank firing cartridge (e.g., cartridges comprising powder without a bullet or other projectile) for providing the explosive power to project the dart or projectile from the firearm. In example forms, the firearm comprises a barrel having a bore formed therein, and the breech adapter is removably engagable with a portion thereof. Preferably, the breech adapter includes a spring-biased extractor for providing convenient loading, firing and ejecting of the cartridge. Additionally, the breech adapter preferably includes a baffle rod for muffling the sound of the explosion of the blank firing cartridge, and reducing the amount of heat and flames that are exposed to the dart to be fired from the barrel of the firearm.

Figure 1A:
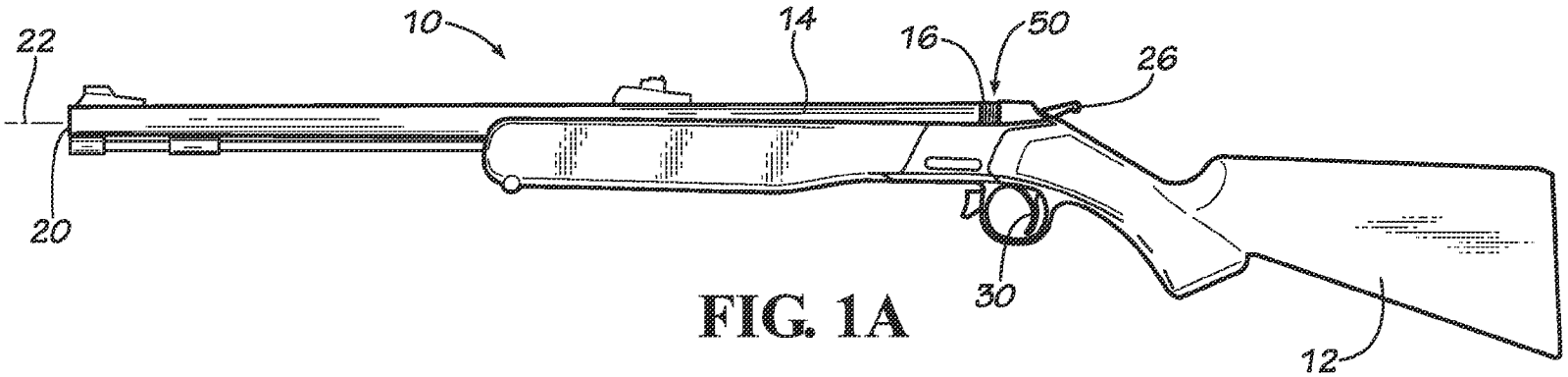
FIG. 1A shows a side view of an animal capture dart gun according to an example embodiment of the present invention.
Figure 1B:
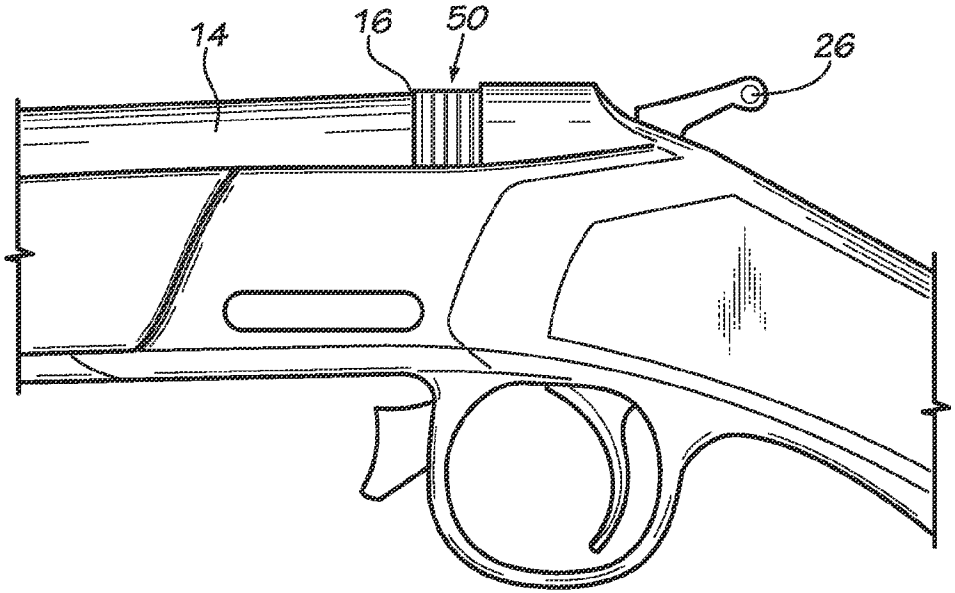
FIG. 1B shows an enlarged view of a portion of the animal capture dart gun of FIG. 1A.
Figure 2A:
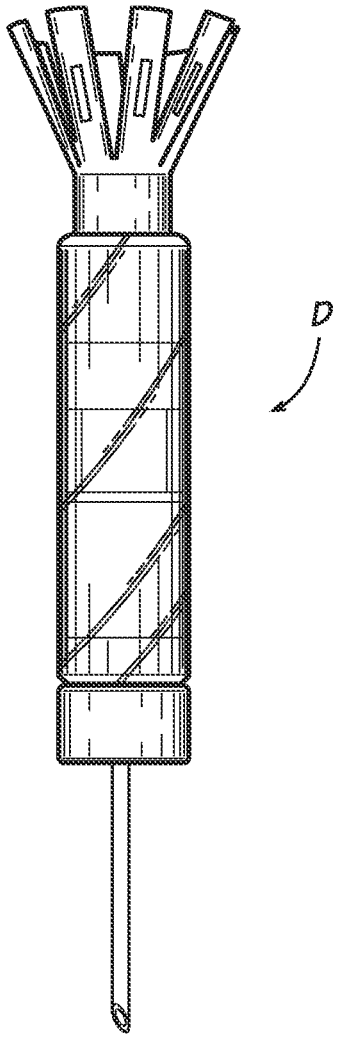
FIG. 2A shows an example dart for use with the animal capture dart gun of FIG. 1A.
Figure 2B:
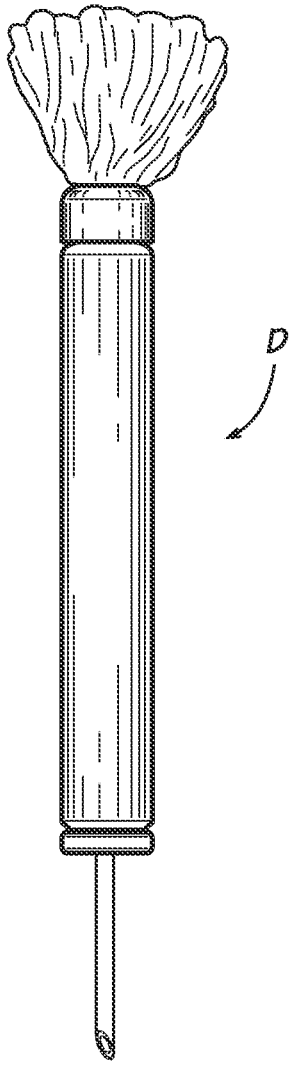
FIG. 2B shows another example dart for use with the animal capture dart gun of FIG. 1A.

With reference now to the drawing figures, wherein like reference numbers represent corresponding parts throughout the several views, FIG. 1 shows a animal capture dart gun or firearm 10 for projecting a dart D therefrom according to an example embodiment of the present invention. In the depicted embodiment, the firearm 10 is in the form of a break action firearm and includes a stock 12, a barrel 14, a hammer 26, a trigger 30, a firing pin P (see FIG. 10), and a breech plug or adapter 50. The barrel 14 is pivotally mounted to a frame 15 and extends along a longitudinal axis 22 from a breech end 16 to a muzzle end 20. The barrel 14 comprises a bore 40 (extending from the breech end 16 to the muzzle end 20) that is axially aligned with the longitudinal axis 22. In example embodiments, the barrel 14 is substantially similar to a muzzle-loading firearm barrel with a rifled or smooth bore and an open breech end, and having a bore size of approximately .50 caliber or 0.5" inches in diameter. Preferably, the darts D (shown in FIGS. 2A-B) comprise a diameter of about 0.5" inches so that the darts are slidably engagable with the bore 40 with a close fit. Typically, the bore being rifled or smooth has no effect when considering the accuracy of projecting a dart, and in some cases, the rifled bore may contribute to relieving the gas within the barrel. Alternatively, the firearm of the present invention can take the form of any other type of break action firearm (such as for example a firearm utilizing breech loaded center-fire or rim-fire cartridges), a pivot action, falling block action, rolling block action, or other forms of single shot firearms that can be modified to accept the breech adapter. The firearm can be in the form of a long gun such as a rifle or shotgun, or can be a handgun or pistol. As such, the dart D or projectiles to be projected from the bore 40 may be sized accordingly, to match the bore of the firearm.

In one example form, the darts D to be used with the dart gun of the present invention are manufactured and sold by Palmer Cap-Chur Inc., but the dart gun of the present invention is readily adapted for use with various darts of other formats and/or sources. The darts D have front portion having a syringe or sharp needle to penetrate the animal subject, a central body portion to contain the medication or tranquilizing substance, and a rear end containing fletchings for stabilizing the dart D while in flight. In one form, the dart comprises a primer which provides for expelling the substance within the animal subject on impact. In another form, the dart comprises a pressurized valve that allows the gasses provided from the explosion of the blank firing cartridge C to pressurize the medicine, which is expelled within the animal subject on impact. Optionally, other darts or other projectiles may be used as desired.

Figure 3:
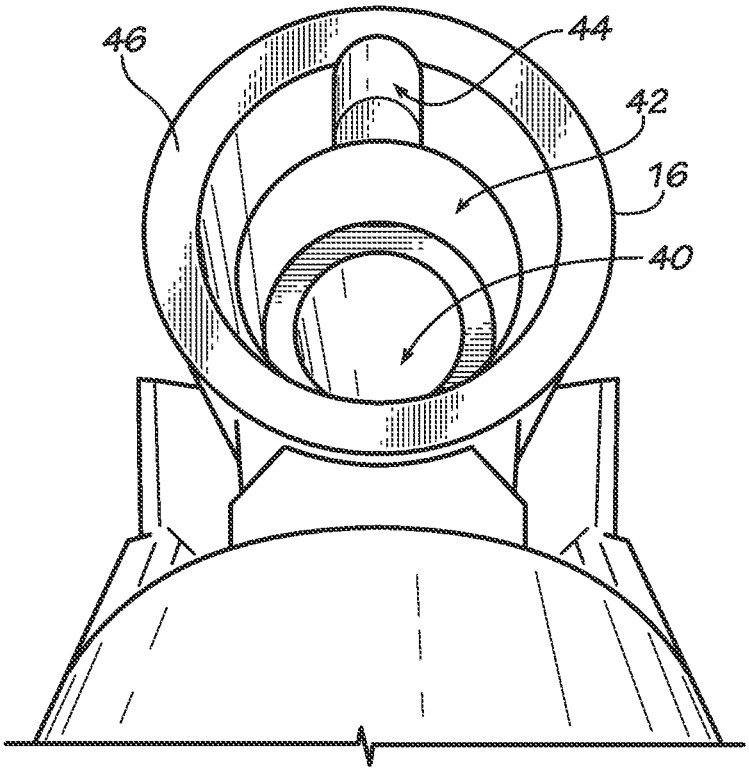
FIG. 3 shows a perspective view of the animal capture dart gun shown in FIG. 1A, showing portions of the breech in the open position.
Figure 10:
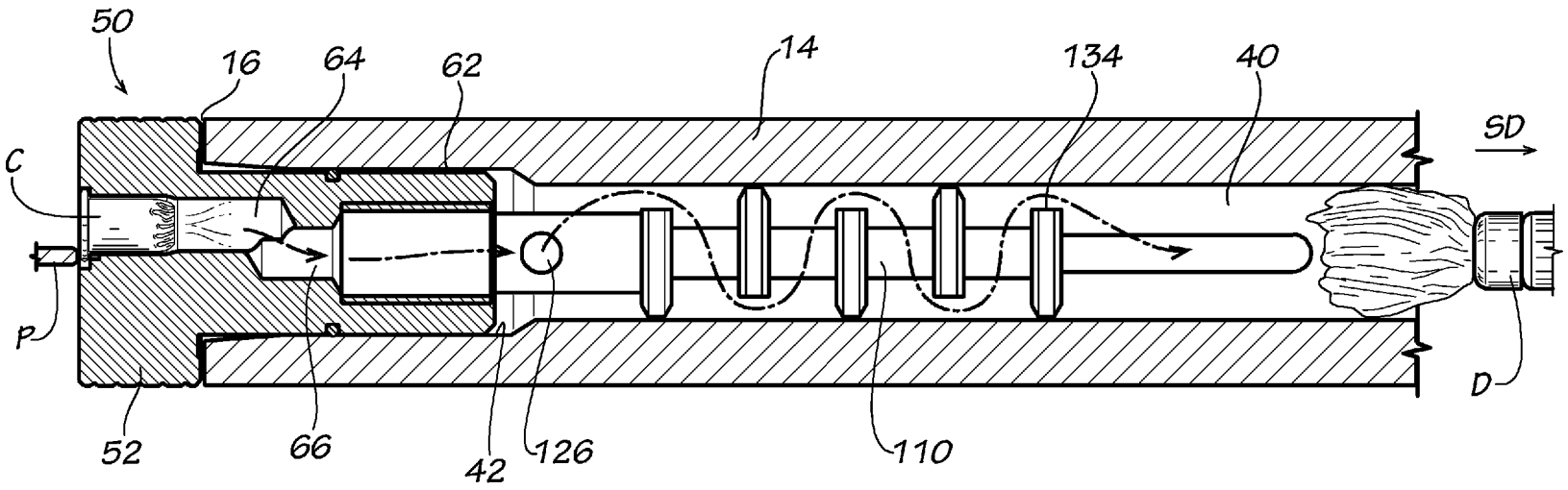
FIG. 10 shows a partial cross-sectional view of portions of the animal capture dart gun shown in FIG. 1, showing the breech adapter removably engaged with the breech of the barrel and the dart firing from the bore, and showing the pathway for the gases resulting from the explosion of a cartridge.

As depicted in FIG. 3, the breech end 16 of the barrel 14 comprises a breech adapter chamber 42 and a notch 44. The breech adapter chamber 42 generally forms a smooth-surfaced cylindrical opening for receiving the breech adapter 50, and the notch 44 provides an area for receiving a portion of the breech adapter 50 (as will be described below). Generally, the breech chamber adapter 42 is axially aligned with the longitudinal axis 22 of the bore 20, and the notch 44 formed within a portion of the chamber 42 (extending from an end face 46 towards the muzzle end 20) is generally semi-circular. As depicted in FIG. 10, a chamfered portion or oblique transition surface 46 is optionally provided between the wall of the breech adapter chamber 42 and the bore 40. The notch 44 (as will be described below), preferably provides for selective engagement with portions of the breech adapter to provide for convenient loading, firing and ejecting of the cartridge.

Figure 4:
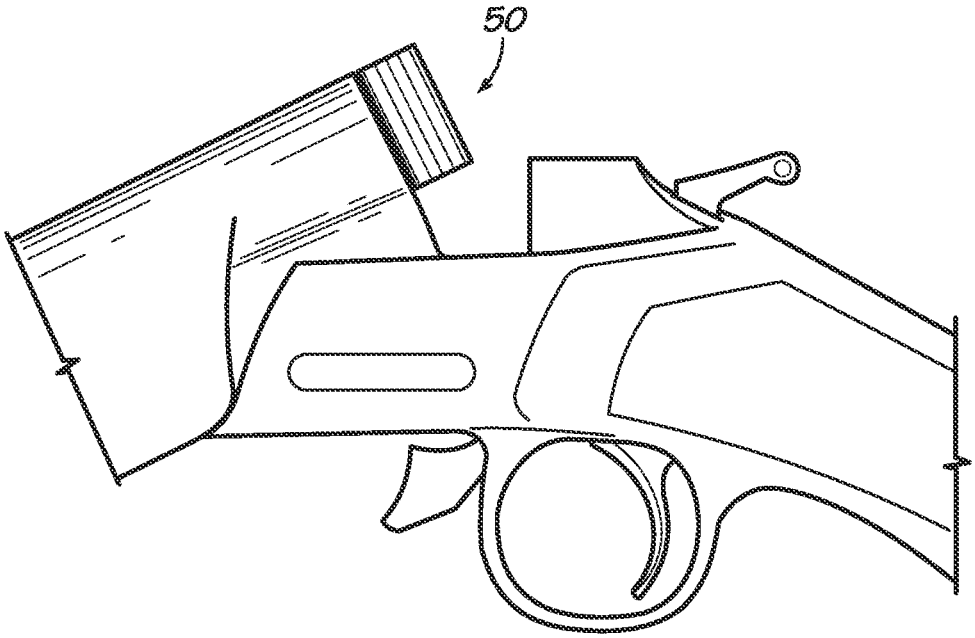
FIG. 4 shows an enlarged view of a portion of the animal capture dart gun of FIG. 1A, showing the breech in the open position wherein a breech adapter is removably engaged therewith.
Figure 5:
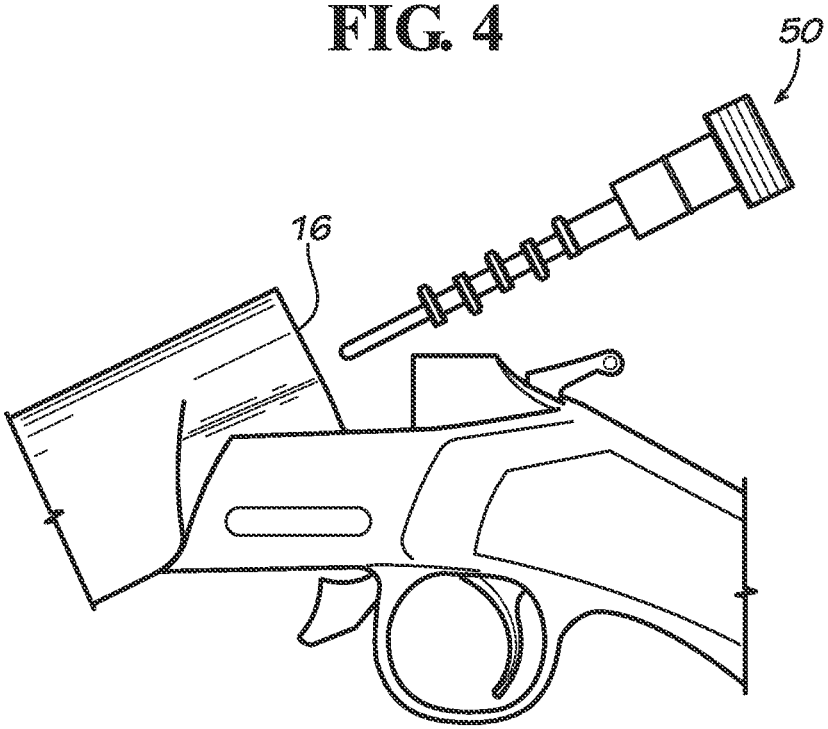
FIG. 5 shows the enlarged view of the animal capture dart gun of FIG. 4, showing the breech in the open position wherein the breech adapter is removed from engagement with the breech.

FIGS. 4-5 show the break action open wherein the breech adapter 50 is removably engaged within the breech adapter chamber 42 (FIG. 4) and removed from engagement with the breech adapter chamber 42 (FIG. 5). Preferably, the breech adapter 50 provides a chamber for receiving a propellant cartridge such as a blank firing cartridge C (e.g., cartridges comprising a charge of gunpowder without the bullet) for providing the explosive power to project the dart or projectile from the firearm 10. In example forms, the breech adapter 50 is configured to receive a .22 caliber blank cartridge. The .22 caliber cartridges can be in the form of firearm approved cartridges or in the form of construction blanks (used with construction tools) that are not classified as firearm cartridges by regulatory agencies. Preferably, as will be described below, the breech adapter 50 allows for convenient loading, firing and ejecting of the .22 caliber blank cartridge. Alternatively, the breech adapter 50 can be configured to receive a plurality of other calibers or configurations of blank cartridges or other propellant sources.

Figure 6A:
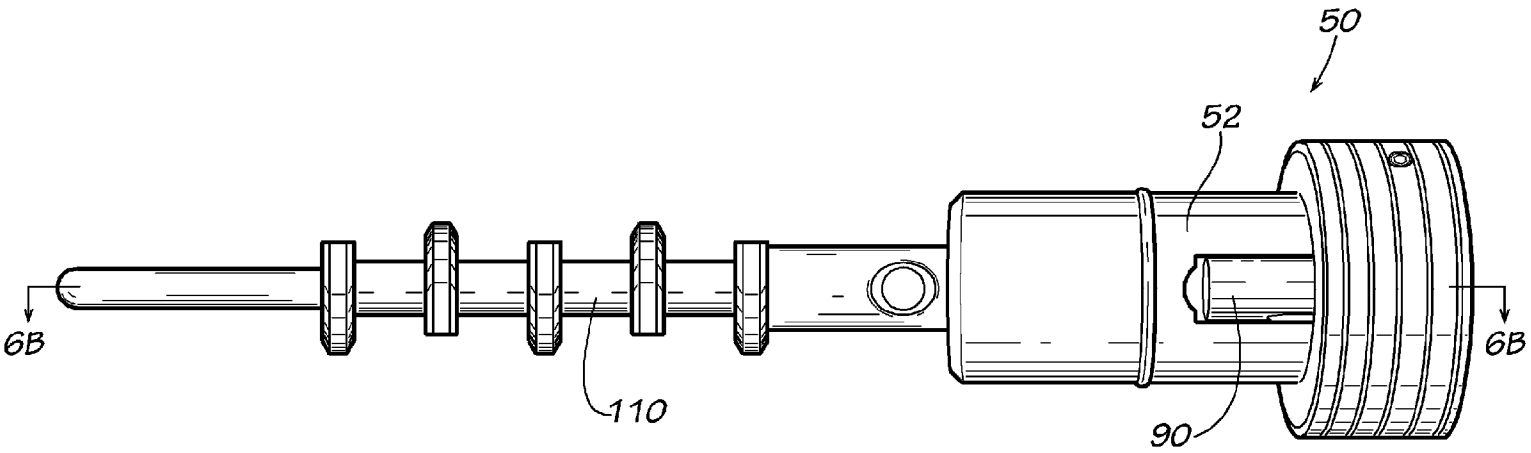
FIG. 6A shows a side view of the breech adapter of FIG. 5.
Figure 6B:
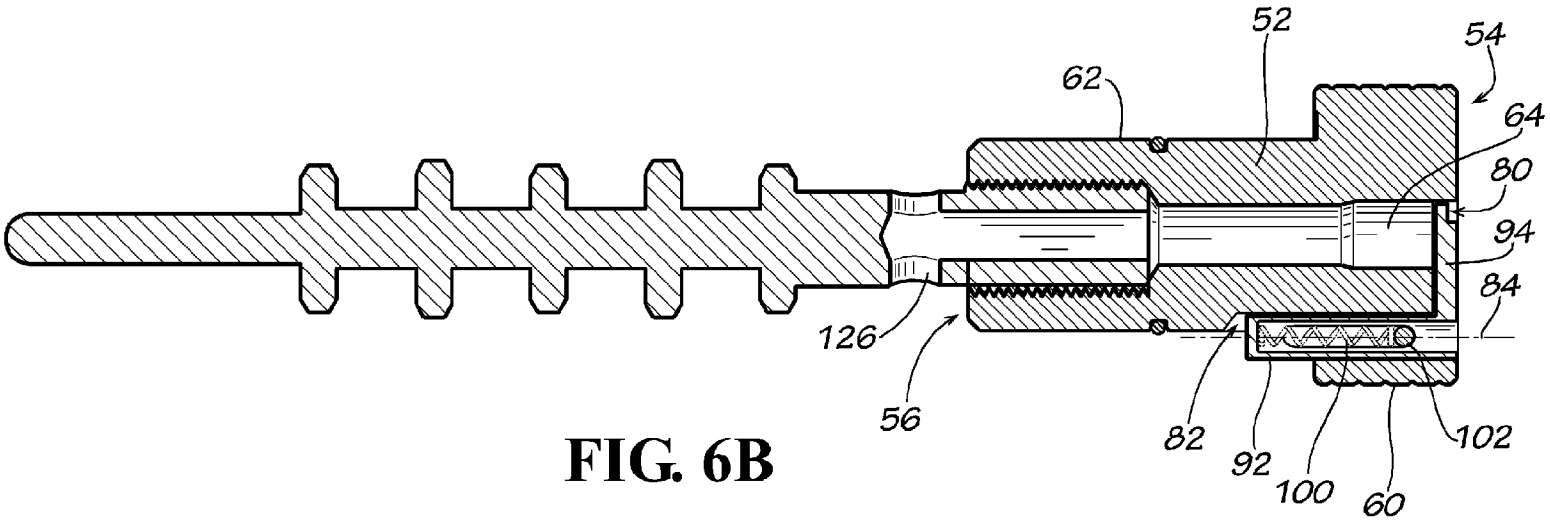
FIG. 6B shows a side cross-sectional view of the breech adapter of FIG. 6A.
Figure 6C:
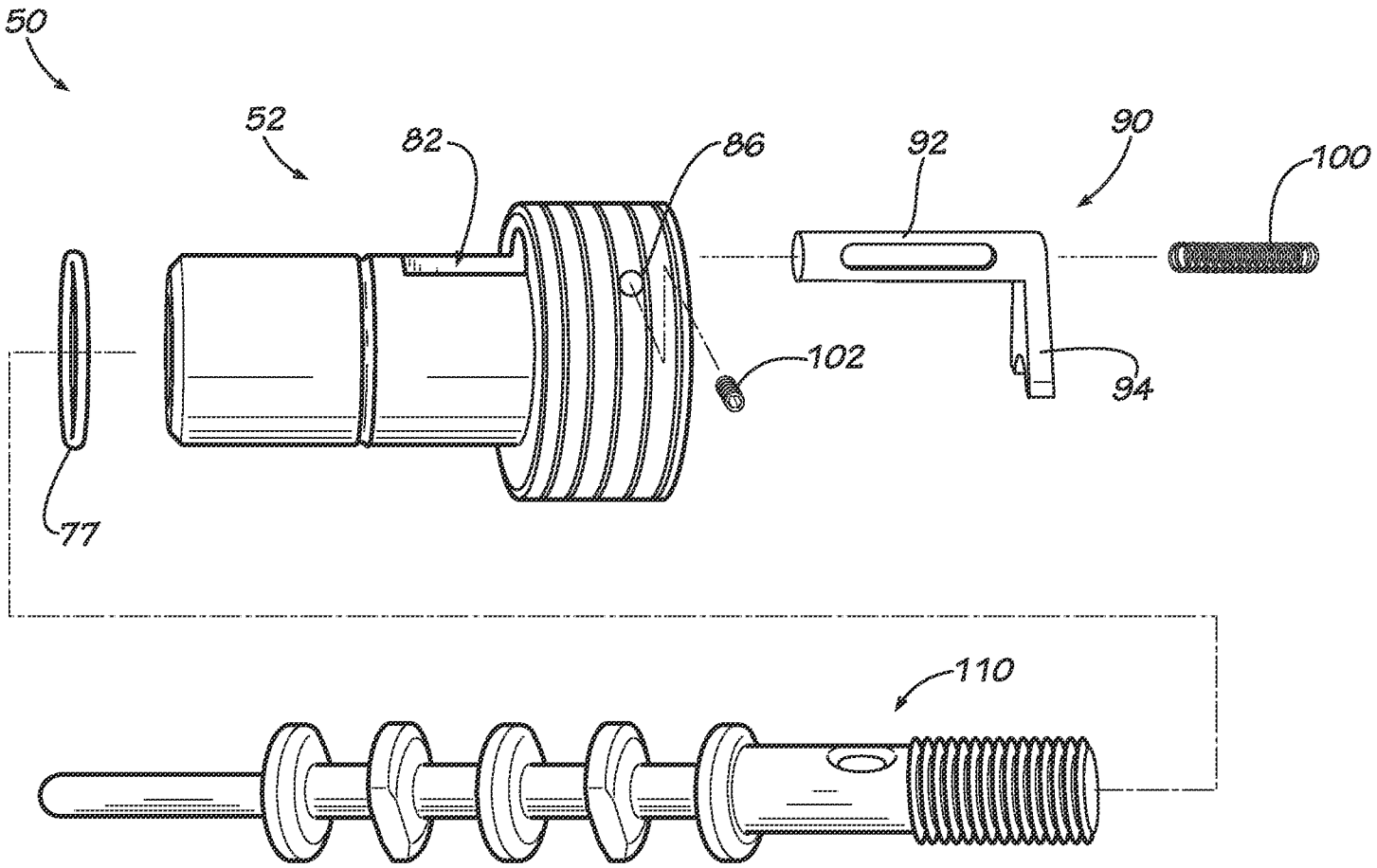
FIG. 6C shows an exploded assembly view of the breech adapter of FIG. 6A.

FIGS. 6A-C show the breech adapter 50 in greater detail. In one form, the breech adapter 50 comprises a plug member 52, an extractor 90, and a baffle rod 110. The extractor 90 is movably mounted to a portion of the plug member 52 and the baffle rod 110 is removably mounted to an end of the plug member 52, for example, to form a syringe-like assembly. Referring back to FIGS. 4-5 (also see FIG. 10), when the breech adapter is removably mounted to the breech end 16 of the barrel 14, the baffle rod 110 is received within the bore 40 and a portion of the plug member 52 is received by the breech adapter chamber 42. Generally, the plug member 52 is axially aligned with the baffle rod 110 and the extractor 90 is laterally offset therefrom.

Figure 7A:
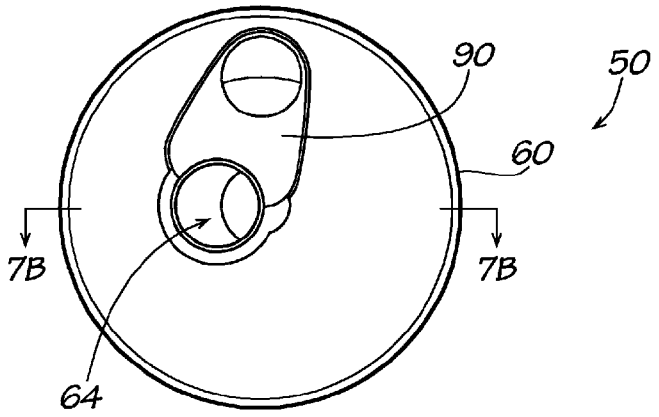
FIG. 7A shows a first end view of a plug member of the breech adapter of FIG. 6A.
Figure 7B:
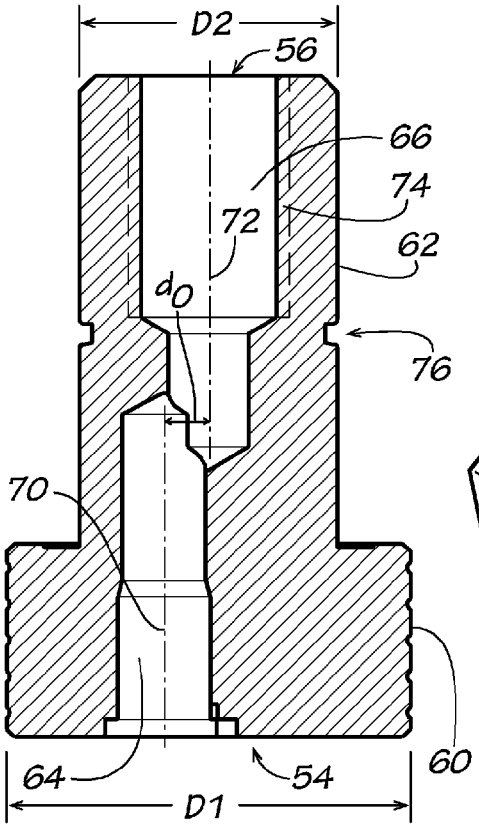
FIG. 7B shows a cross-sectional view of the plug member of FIG. 7A taken along line 7B-7B.

FIGS. 7A-B show the plug member 52 in greater detail. The plug member 52 has a generally cylindrical body that extends from a first or proximal end 54 to a second or distal end 56. The first end 54 comprises a first body portion 60 that defines a first diameter D1 and the second end 56 comprises a second body portion 62 that defines a second diameter D2. The second body portion 62 (defining the second diameter D2) is preferably sized for removable engagement with the breech adapter chamber 42 of the breech end 16, thus the second diameter D2 is substantially similar to the diameter of the breech plug chamber 42. Preferably, a continuous circumferential channel 76 is formed along the periphery of the second body portion 62 for receiving an O-ring or gasket 77, for example, to provide a seal between the second body portion 62 and the breech adapter chamber 42. The first body portion 60 includes an expanded gripping surface (defining the first diameter D1) that is greater than the diameter of the breech plug chamber 42. Preferably, the first diameter D1 is substantially similar to the outer diameter of the breech end 16 of the barrel 14.

As depicted in FIG. 7B, the plug member 52 comprises two chambers 64, 66. The first chamber 64 extends from the first end 54 towards the second end 56 along a first axis 70 and the second chamber 66 extends from the second end 56 towards the first end along a second axis 72. Preferably, the chambers 64, 66 at least partially intersect to provide fluid communication therebetween and to define an internal propellant conduit extending through the plug member 52 from the first end 54 to the second end 56. The first chamber 64 is provided for receiving a portion of the extractor (as will be described below) and for receiving the blank firing cartridge C. Preferably, the first chamber 64 is sized and configured to receive only a blank firing cartridge C. Thus, a firing cartridge having a bullet mounted therewith will not fit properly within the first chamber 64, such that the dart gun is inoperable to receive and/or fire a bullet, and is only operable with blank cartridges not having a bullet. In one form, the first chamber 64 (extending along the first axis 70) is eccentrically offset from the central axis (axially aligned with the second axis 72) of the plug member 52. Thus, when the firing pin P of the firearm 10 is a center-fire firing pin, the blank firing cartridge to be received therein is in the form of a rim-fire cartridge (see FIG. 10), and the offset distance $d_O$ (see FIG. 7B) is selected to allow the center-fire firing pin to impact the rim of the rim-fire cartridge. The offset between the cartridge chamber 64 and the propellant delivery chamber 66 provides an additional safety provision against the dart gun firing a bullet. Alternatively, the firing pin may be eccentrically offset (e.g., a rim-fire firing pin) and the blank cartridge may be a center-fire cartridge. Alternatively, the first chamber 64 may be axially aligned with the second chamber 66 such that the firing pin and the blank firing cartridge are of the same form, for example, both center-fire or both rim-fire. The second chamber or propellant delivery chamber, as will be described below, comprises a threaded connection area 74 for removable engagement with a portion of the baffle rod 110.

Figure 8:
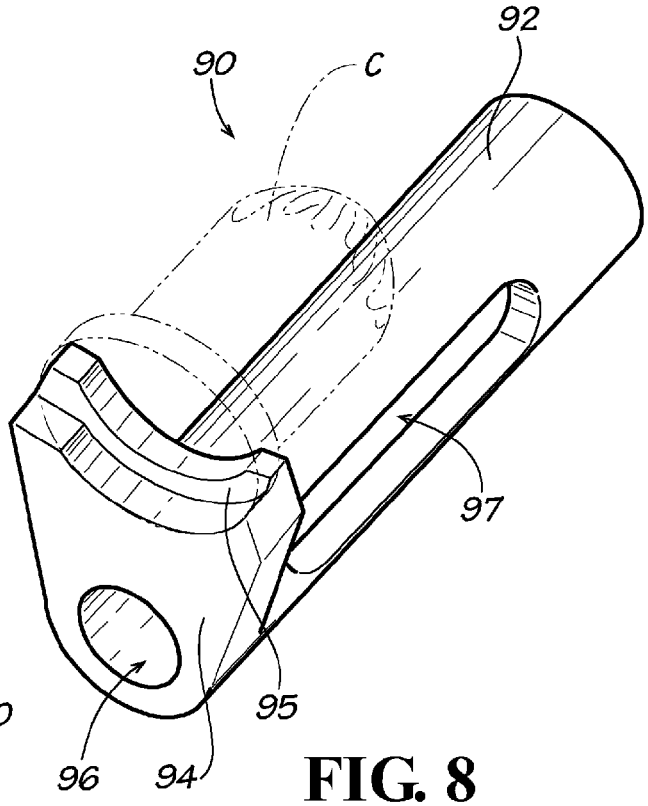
FIG. 8 shows a perspective view of an extractor of the breech adapter of FIG. 6A.

FIG. 8 shows the extractor 90 in greater detail. The extractor 90 generally has an elongate cylindrical body 92 and a leg or flange 94 generally extending perpendicular or transverse from the body 92. A chamber 96 is formed within the extractor 90 and extends from the flange side through a portion of the body 92. A slot 97 is formed along a portion of the body 92 and provides access to the chamber 96. The flange 94 comprises a generally radial rib or foot 95 extending from the flange 94 for seating against a portion of the firing cartridge C. Generally, standard cartridges C having rim-fire or center-fire casings comprise a rim R, which extends laterally from the back end thereof and provides for convenient engagement with the foot 95. Referring back to FIG. 6B, the extractor 90 movably mounts to a portion of the plug member 52 and provides for convenient loading, firing and ejecting of the cartridge C. As depicted, a recess 80 and channel 82 are formed within a portion of the plug member 52 for receiving the extractor 90 (also see FIG. 6C). The recess 80 communicates with the first chamber 64 at the first end 54 of the first body portion 60, and the channel 82 (communicating with the recess 80) extends from the first end 54 of the first body portion 60 towards the second end 56. In one example form, the channel 82 extends along a longitudinal axis 84 that generally coincides or is relatively close (generally laterally offset) to the periphery of the second body portion 62 such that both ends of the channel 82 are exposed. Thus, a portion of the cylindrical body 92 remains exposed (along the outer surface of the second body portion 62) when seated within the chamber 82. In one example form, a biasing member 100 and a retaining pin 102 provide for movably mounting the extractor 90 to extend and retract axially relative to the plug member 52. The biasing member 100 is received within the chamber 96 and the retaining pin 102 extends through the slot 97 and within a pin opening 86 formed within a portion of the first body portion 60 (see FIG. 6C). Optionally, other springs or types thereof, spring mechanisms, and/or other biasing means can be used as desired to replace the biasing member 100 and retaining pin 102. In a neutral position (as depicted in FIG. 6B, 7A, 11A, 11B), the pin 102 contains the body 92 within the channel 82, and the biasing member 100 bears against the pin such that the extractor 90 is biased towards the second end 56 of the plug body 52 wherein the flange 94 is seated within the recess 80. In an ejection position (see FIG. 11D), the flange 94 of the extractor 90 extends from the first end 54 of the plug member 52, thereby overcoming the bias of the biasing member 100 that forces the flange 94 towards the neutral position.

Figure 9A:
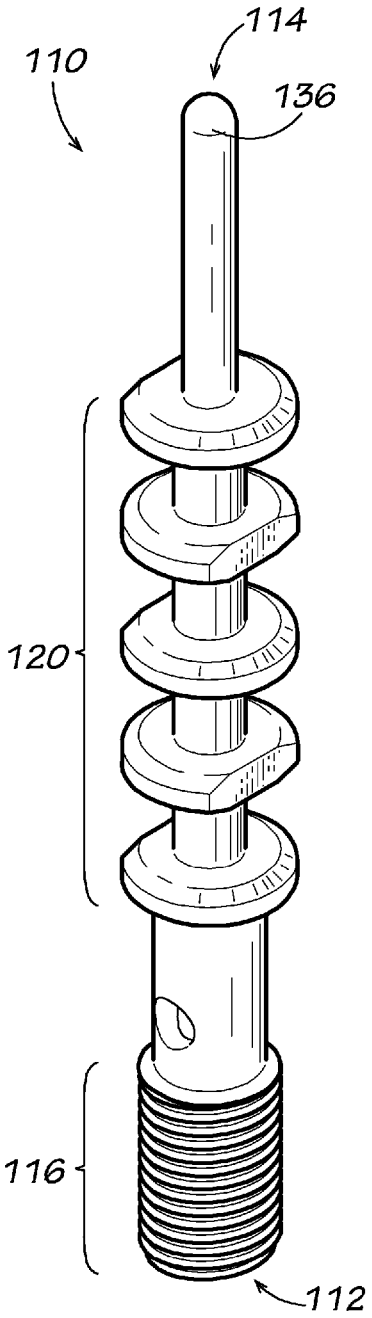
FIG. 9A shows a perspective view of a baffle rod of the breech adapter of FIG. 6A.
Figure 9B:
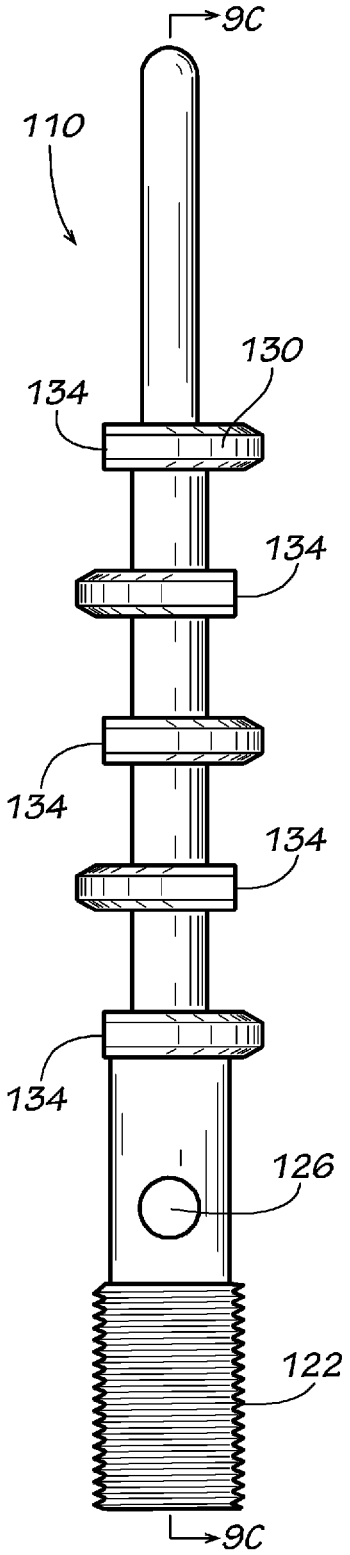
FIG. 9B shows a side view of the baffle rod shown in FIG. 9A.
Figure 9C:
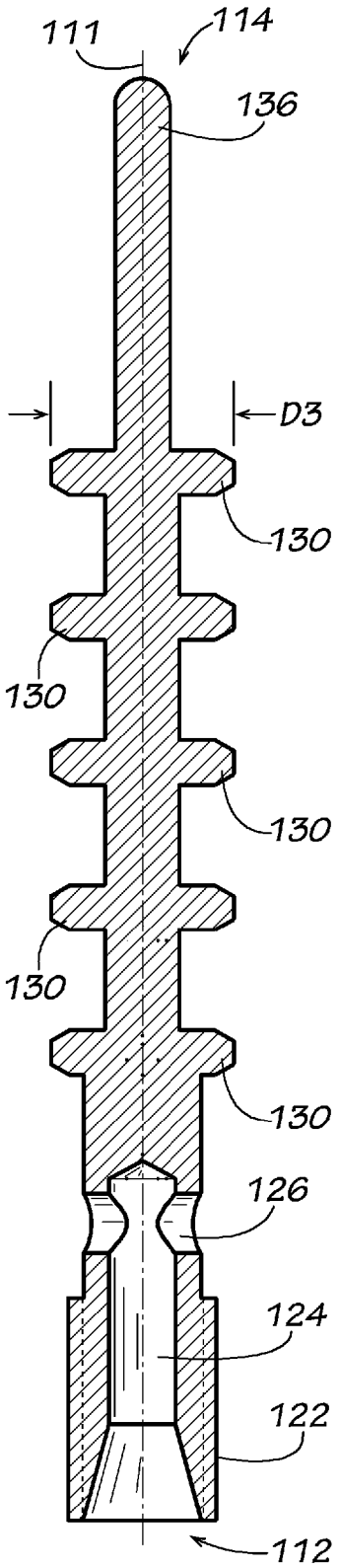
FIG. 9C shows a cross-sectional view of the baffle rod shown in FIG. 9B taken along line 9C-9C.

FIG. 9A-C shows the baffle rod 110 in greater detail. The baffle rod 110 is generally cylindrical in shape and extends along a longitudinal axis 111 from a first end 112 to a second end 114. Generally, the baffle rod 110 comprises a connecting or mounting portion 116 and a baffle portion 120. The connecting portion 116 comprises a threaded connection area 122 defining an outside thread diameter for removable engagement with the threaded connection area 74 of the second chamber 66 of the plug member 52. The first end 112 includes a chamber 124 that extends towards the second end 114 wherein one or more transversely directed propellant port(s) 126 communicates therewith (transverse or lateral indicating a direction generally perpendicular relative to the axial direction of the lengthwise axis of the chamber 124 and the longitudinal axis 22 of the bore). The baffle portion 120 generally comprises a plurality of disc-like ribs or baffles 130 that are axially spaced along the longitudinal axis 111. The baffles 130 extend transversely from the core shaft of the baffle rod, at axially spaced positions, and in the depicted embodiment are generally parallel to and spaced equally from adjacent baffles. Preferably, the baffles 130 provide for suppressing the noise of the explosion of the firing cartridge C and block the heat and the flames of the explosion from damaging the dart D. The baffles 130 comprise a diameter D3 that is substantially similar to the diameter of the bore 40. As depicted in FIGS. 9A-B, the baffles 130 are generally C-shaped or D-shaped wherein a portion of each disc-like rib is removed to define a face 134. In one form, the faces 134 are orientated such that they alternate and oppose one another. For example, as shown in FIG. 9B, the faces 134 of the baffles 130 alternate between the left and right sides of the baffle rod 110. Optionally, other shapes, cut-outs, facings, or orientations may be used with the baffles 130 as desired. The second end 114 of the baffle rod 110 forms a nipple 136 for engaging the rear end of the dart D. In one example form, after loading the dart D or other projectile within the bore 40 at the breech end 16, the nipple 136 contacts the rear end of the dart D and provides assistance for driving the same therein. Preferably, in addition to driving the dart D within the bore 40, the nipple 136 acts as a spacer (ensuring the dart remains a particular distance away from the breech adapter) to insulate the dart fletchings from the flame caused by the explosion of the blank firing cartridge C.

Figure 12A:
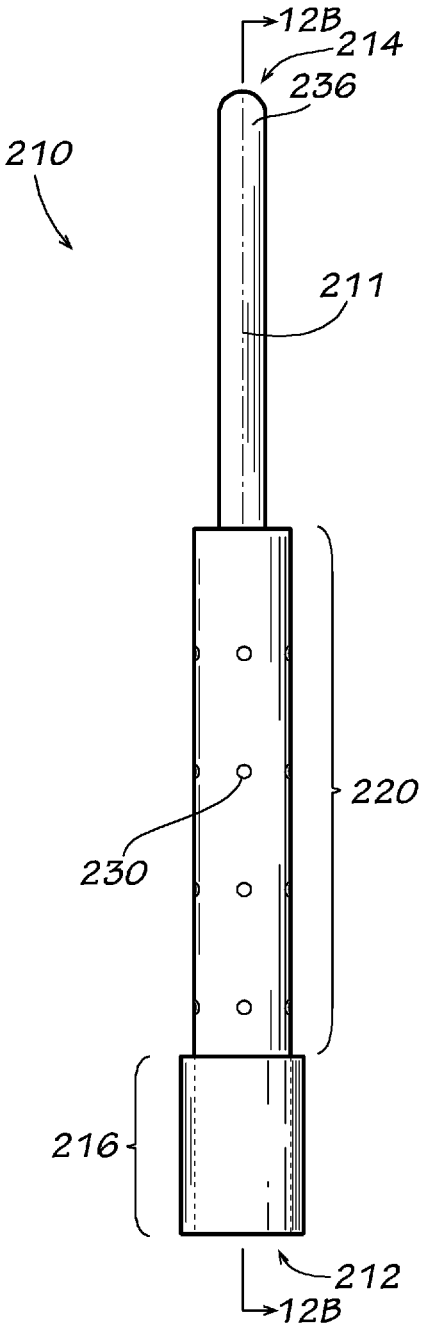
FIG. 12A shows a side view of the baffle rod according to an additional example embodiment of the present invention.
Figure 12B:
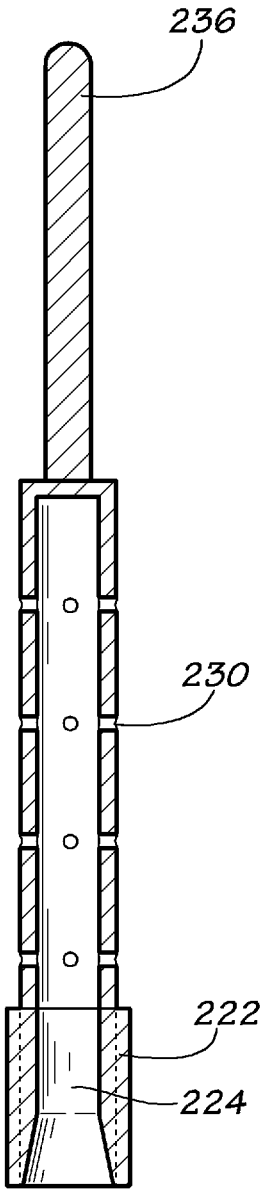
FIG. 12B shows a cross-sectional view of the baffle rod shown in FIG. 12A taken along line 12B-12B.

Optionally, the baffle rod can be configured or formed as desired. FIGS. 12A-B show a baffle rod 210 according to another example embodiment of the present invention. Generally, the baffle rod 210 is substantially similar to the baffle rod 110, for example, wherein they both comprise a connecting portion 116, 216, a baffle portion 120, 220, a connection area 122, 222, a chamber 124, 224 and a nipple 136, 236. Preferably, as depicted in FIG. 12B, the chamber 224 extends from the first end 212 (towards the second end) to the baffle portion 220 wherein ports 230 are formed along a generally cylindrical body 226. Preferably, the ports 230 communicate with the chamber 224 such that gasses entering the first end 212 flow through the chamber 224 (within the baffle portion 220) and exit the ports 230. As depicted, 16 ports are provided wherein four sets of four ports 230 are axially spaced apart along the baffle portion 220. Preferably, the quantity, size, spacing, orientation and/or configuration of the ports may vary as desired.

FIG. 10 shows the breech adapter 50 movably mounted with the barrel 14 of the firearm 10, and shows the pathway or flow of the gases resulting from the explosion of the blank firing cartridge C. As depicted, the breech adapter 50 is movably mounted to the breech end 16 of the barrel 14 wherein the second body portion 62 is inserted within the breech adapter chamber 42, the body portion of the extractor 90 is within the notch 44 (see FIGS. 11A-B), the baffle rod 110 is within the bore 40, and the blank firing cartridge C is seated within the first chamber 64 of the plug member 52. After cocking the hammer and pulling the trigger, the firing pin P actuates forward and contacts the blank firing cartridge C, causing the gunpowder within the firing cartridge C to explode. As depicted, the explosion of the gunpowder causes high pressure gasses to travel through portions of the breech adapter towards the muzzle end 20, thereby causing the dart D to be fired in the shot direction SD. From the first chamber 64, the gasses travel to the second chamber 66 where they enter the chamber 124 of the baffle rod 110. The gasses continue traveling through the chamber 124, exiting therefrom through the ports 126, and travel in a circuitous, serpentine or wave-like pattern around the alternating faces 134 of the baffles 130. The gasses then contact the dart to cause the same to fire from the barrel 14 in the shot direction SD. Preferably, as briefly mentioned above, the baffles 130 both suppress the noise of the explosion of the firing cartridge C and block the heat and flame of the explosion from damaging the dart D fletchings. Optionally, other forms of baffles or alternate configurations of the same may be used to provide for muffling the sound of the explosion and blocking the heat and flames of the explosion from damaging the dart D.

Figure 11A:
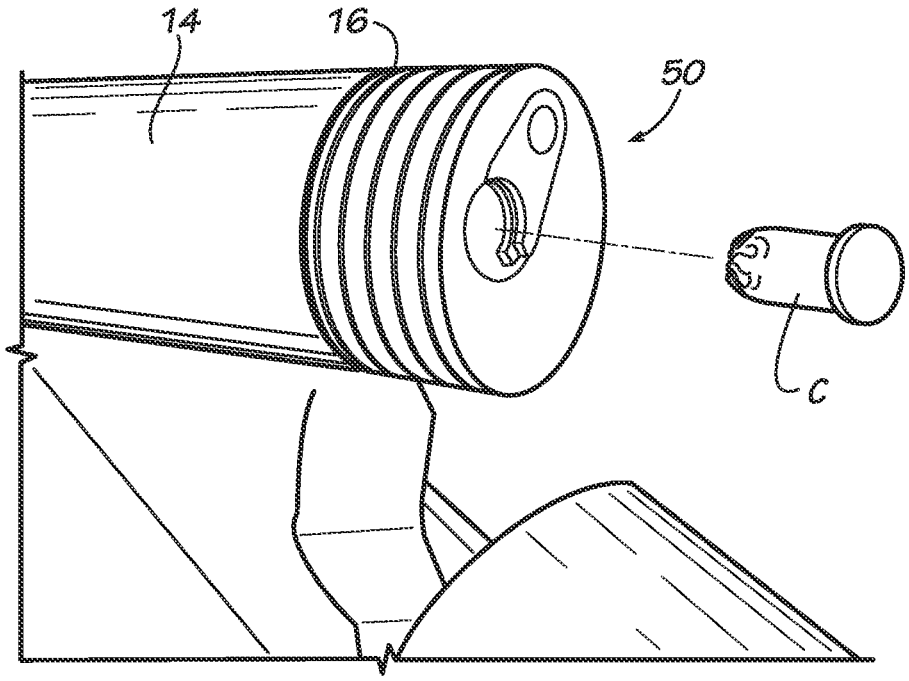
FIG. 11A shows a perspective view of the animal capture dart gun shown in FIG. 4, showing the breech adapter removably engaged with the breech with the extractor is biased inwardly, and wherein a blank firing cartridge is being inserted into a first chamber of the plug member.
Figure 11B:
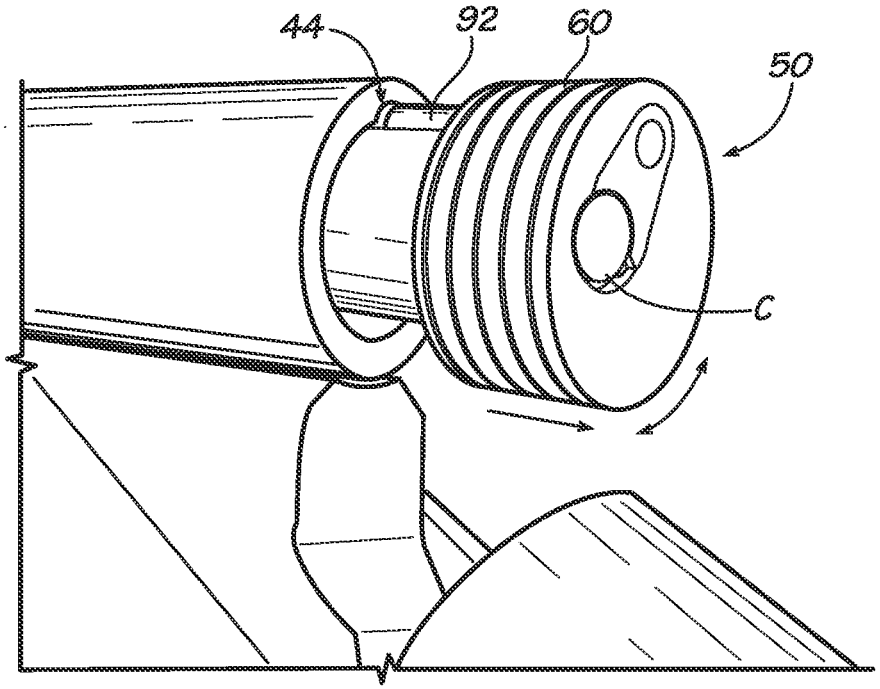
FIG. 11B shows a perspective view of the animal capture dart gun shown in FIG. 11A, showing the breech adapter partially removed from the breech and showing the alignment of a body portion of the extractor and a notch formed within a portion of the breech.
Figure 11C:
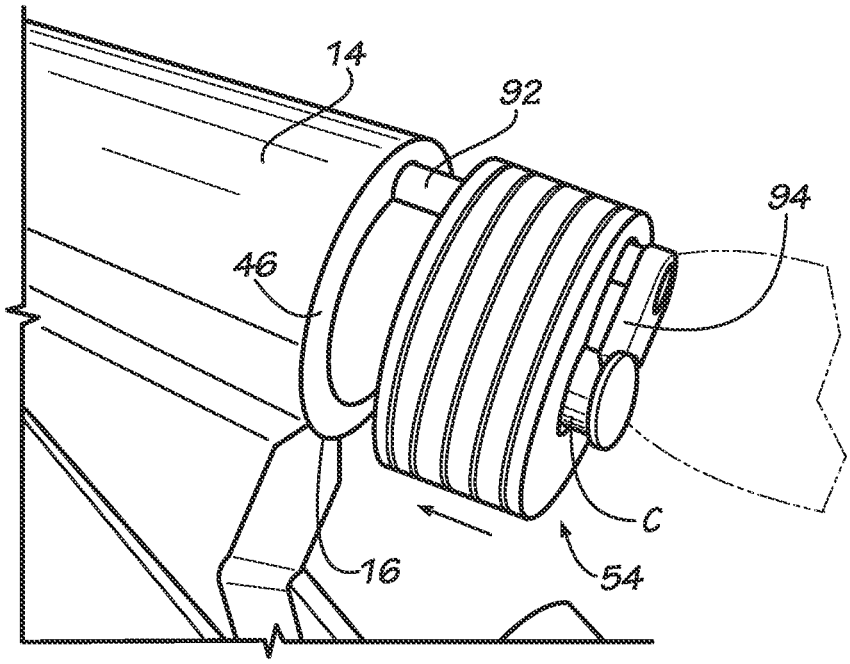
FIG. 11C shows a perspective view of the animal capture dart gun shown in FIG. 11B, showing the breech adapter partially removed from the breech wherein a body portion of the extractor and the notch within the breech are unaligned such that the extractor protrudes from the plug member and begins to remove the used blank firing cartridge therefrom.
Figure 11D:
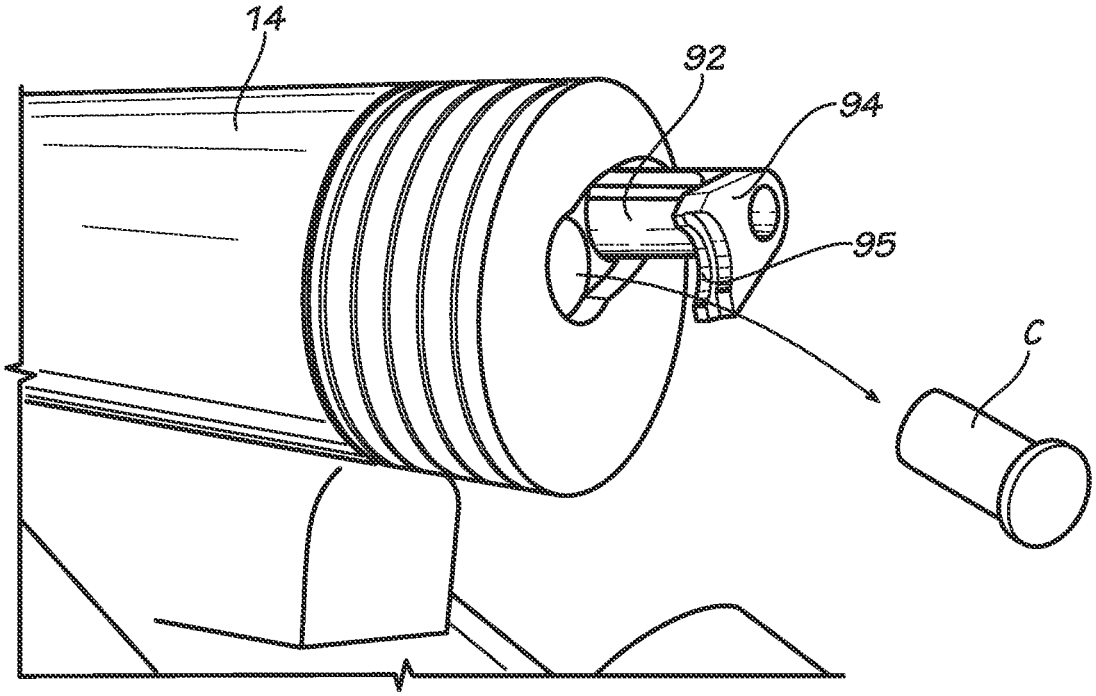

FIGS. 11A-D show the ejection operation of the cartridge C after firing the dart D. FIG. 11A shows the breech adaptor 50 installed in the firearm, and a cartridge C being loaded therein for use. After firing the dart, the action is opened so that the breech adapter 50 can be partially removed from the breech end 16 of the barrel 14. As depicted in FIG. 11B, the first body portion 60 of the plug member 52 is pulled away from the breech end 16 until the body portion 92 of the extractor 90 is entirely removed from the notch 44. The breech adapter 50 is then rotated in either the clockwise or counter-clockwise direction until the body portion 92 of the extractor is out of alignment with the notch 44. The breech adapter 50 is then pressed back within the breech end 16 of the barrel, causing the body portion 92 to contact the end face or contact face 46 of the breech end 16, which causes the flange 94 of the extractor 90 to extend outwardly from the first end 54 of the plug member 52 (see FIG. 11C). As the flange 94 begins to move outwardly, the rib 95 of the flange 94 (which is engaged with the rim R of the cartridge C) begins to remove the cartridge C from the first chamber 64 of the breech plug. When the breech adapter 50 is entirely inserted within the breech end 16, the flange 94 fully extends from the first end 54 to an ejection position, and the cartridge C is ejected from the first chamber 64 (see FIG. 11D). To reload the firearm 10, the breech adapter 50 is removed from the breech end 16 of the barrel 14 and a dart D is inserted into the breech end 16. Optionally, a push rod (see FIG. 1) can be removed from the barrel 14 to assist in pushing the dart D within the bore 40. The breech adapter 50 is then removably mounted to the breech end 16 (with the body portion 92 of the extractor aligned with the notch 44), and a blank firing cartridge C is placed within the first chamber 64. The barrel 14 is then pivoted back to a closed position and the firearm 10 is ready to be cocked and fired.

In example embodiments, the breech adapter 50 is formed from stainless steel. Optionally, other metals (e.g., carbon steel, etc.), composites, ceramics, polymers, and/or other materials or combinations thereof may be used as desired. Preferably, the O-ring 77 seal is formed from a natural or synthetic rubber or rubber-like material, silicone, elastomeric polymer and/or other resilient compressible material or other materials that may be used to provide an efficient and easily breakable seal with the breech plug chamber. Optionally, other materials may be used as desired.

In additional example embodiments, the breech adapter 50 may be used with additional types of firearms, such as for example a pistol or handgun.

While the invention has been described with reference to preferred and example embodiments, it will be understood by those skilled in the art that a variety of modifications, additions and deletions are within the scope of the invention, as defined by the following claims.

What is claimed is:

1. A dart gun comprising:

a barrel comprising a bore defining a longitudinal axis extending from a muzzle end to a breech end, the breech end comprising a breech adapter receiving chamber; and a breech adapter for removable engagement with the breech adapter receiving chamber, the breech adapter comprising:

a plug comprising a first chamber portion at a proximal side thereof for receiving a cartridge, and a second chamber portion at a distal side thereof for delivering a propellant charge from the cartridge to the barrel;

an extractor movable between a first position wherein the cartridge is engaged with the extractor and seated in the first chamber portion of the plug, and a second position wherein the cartridge is engaged with the extractor and retracted out of the first chamber portion of the plug; and a baffle member extending from the distal side of the plug.

2. The dart gun of claim 1, wherein the first chamber portion of the plug is eccentrically offset from the longitudinal axis of the barrel bore.

3. The dart gun of claim 1, wherein the first chamber portion of the plug is transversely offset from the second chamber portion of the plug.

4. The dart gun of claim 1, further comprising a notch extending transversely from the breech adapter receiving chamber and a contact face adjacent the notch, wherein a body portion of the extractor is received in the notch with the extractor in its first position in a first rotational orientation of the breach adaptor relative to the breech end of the barrel, and wherein the body portion of the extractor abuts the contact face in a second rotational orientation of the breach adaptor relative to the breech end of the barrel to retract the extractor into its second position.

5. The dart gun of claim 1, wherein the baffle member comprises a plurality of transversely oriented baffles, each baffle defining a propellant passage between the baffle and the bore of the barrel.

6. The dart gun of claim 5, wherein the propellant passages defined by adjacent baffles are transversely offset in an alternating array to define a serpentine propellant path.

7. The dart gun of claim 1, further comprising a biasing member biasing the extractor toward its first position.

8. The dart gun of claim 1, wherein the barrel is pivotally mounted to a stock, and further comprising a break-action mechanism for maintaining the barrel in a fixed position relative to the stock when engaged, and allowing the barrel to pivot relative to the stock when disengaged.

9. The dart gun of claim 1, wherein the first chamber is adapted to receive a blank cartridge, and to prevent loading of a bullet cartridge therein.

10. The dart gun of claim 1, wherein the first chamber is adapted to receive a .22 caliber blank cartridge.

* * * * *